US011329365B2

(12) United States Patent
Liu et al.

(10) Patent No.: US 11,329,365 B2
(45) Date of Patent: May 10, 2022

(54) COUPLED MULTI-BANDS ANTENNAS IN WEARABLE WIRELESS DEVICES

(71) Applicant: Huawei Technologies Co., Ltd., Shenzhen (CN)

(72) Inventors: Hongwei Liu, San Diego, CA (US); Wee Kian Toh, San Diego, CA (US); Ping Shi, San Diego, CA (US)

(73) Assignee: Huawei Technologies Co., Ltd., Shenzhen (CN)

( * ) Notice: Subject to any disclaimer, the term of this patent is extended or adjusted under 35 U.S.C. 154(b) by 177 days.

(21) Appl. No.: 16/863,970

(22) Filed: Apr. 30, 2020

(65) Prior Publication Data

US 2020/0259247 A1 Aug. 13, 2020

Related U.S. Application Data

(63) Continuation of application No. 15/891,911, filed on Feb. 8, 2018, now Pat. No. 10,680,312, which is a continuation of application No. 14/811,621, filed on Jul. 28, 2015, now Pat. No. 9,912,042.

(51) Int. Cl.

| | |
|---|---|
| ***H01Q 1/24*** | (2006.01) |
| ***H01Q 1/52*** | (2006.01) |
| ***G04R 60/08*** | (2013.01) |
| ***H01Q 1/27*** | (2006.01) |
| ***H01Q 21/28*** | (2006.01) |

(52) U.S. Cl.

CPC ..... *H01Q 1/243* (2013.01); *G04R 60/08* (2013.01); *H01Q 1/273* (2013.01); *H01Q 1/521* (2013.01); *H01Q 21/28* (2013.01)

(58) Field of Classification Search

CPC ..... H01Q 1/243; H01Q 1/273; H01Q 1/52; H01Q 21/28; G04R 60/08

USPC ..... 343/702

See application file for complete search history.

(56) References Cited

U.S. PATENT DOCUMENTS

| | | | |
|---|---|---|---|
| 4,754,285 | A | 6/1988 | Robitaille |
| 7,629,934 | B2 | 12/2009 | Rhodes et al. |
| D670,583 | S | 11/2012 | Shaanan |
| RE44,672 | E | 12/2013 | Yang et al. |

(Continued)

FOREIGN PATENT DOCUMENTS

| | | | |
|---|---|---|---|
| CN | 1878010 | A | 12/2006 |
| CN | 101080850 | A | 11/2007 |

(Continued)

OTHER PUBLICATIONS

Marque 2 M165—Plantronics, Mobile Bluetooth Headset, http://www.plantronics.com/us/product/m165, Apr. 8, 2016, 5 pages.

(Continued)

*Primary Examiner* — Andrea Lindgren Baltzell
(74) *Attorney, Agent, or Firm* — Slater Matsil, LLP

(57) ABSTRACT

A wearable wireless device is disclosed. In one embodiment the wearable wireless device includes a circuit board, a housing body housing the circuit board, the housing body having a front side and a back side, a display located at the front side of the housing body, a first antenna element electrically connected to the circuit board and located on the front side of the housing body and a second antenna element electrically connected to the circuit board and located on the front side of the housing body.

20 Claims, 4 Drawing Sheets

(56) References Cited

U.S. PATENT DOCUMENTS

| | | | | |
|---|---|---|---|---|
| 2006/0170599 | A1 | 8/2006 | Gilmore et al. | |
| 2008/0165064 | A1 | 7/2008 | Hill et al. | |
| 2009/0109104 | A1 | 4/2009 | Ide et al. | |
| 2009/0231960 | A1 | 9/2009 | Hutcheson | |
| 2010/0113111 | A1* | 5/2010 | Wong | H04B 1/3838 455/575.5 |
| 2014/0045547 | A1* | 2/2014 | Singamsetty | G04G 21/06 455/552.1 |
| 2014/0218852 | A1 | 8/2014 | Alcazar | |
| 2014/0225786 | A1* | 8/2014 | Lyons | G04G 21/04 343/702 |
| 2014/0266920 | A1 | 9/2014 | Tran et al. | |
| 2014/0354494 | A1* | 12/2014 | Katz | H01Q 9/42 343/718 |
| 2015/0048979 | A1 | 2/2015 | Asrani et al. | |
| 2016/0013544 | A1 | 1/2016 | Lyons et al. | |

FOREIGN PATENT DOCUMENTS

| | | | |
|---|---|---|---|
| CN | 201804995 | U | 4/2011 |
| CN | 102402183 | B | 6/2013 |
| CN | 103378406 | A | 10/2013 |
| CN | 103943945 | A | 7/2014 |
| CN | 104160551 | A | 11/2014 |
| CN | 104752812 | A | 7/2015 |
| EP | 2495621 | A1 | 9/2012 |
| EP | 2750409 | A1 | 7/2014 |
| JP | 2003032139 | A | 1/2003 |
| JP | 2004312157 | A | 11/2004 |
| JP | 2013098923 | A | 5/2013 |
| JP | 2014062852 | A | 4/2014 |
| JP | 2015073824 | A | 4/2015 |
| TW | 201507261 | A | 2/2015 |

OTHER PUBLICATIONS

Plantronics M165 Marque 2 Ultralight Wireless Bluetooth Headset—Compatible with iPhone, Android, and Other Leading Smartphones—Black, http://www.amazon.com/Plantronics-Ultralight-Wireless-Bluetooth-Headset/dp/B00DQ5r, Apr. 8, 2016, 8 pages.

Schmidt, D., Short Review Simvalley Mobile AW-414. Go Smartwatch—NotebookCheck.net Reviews, http://www.notebookcheck.net/Short Review-Simvalley Mibile-AW-414 Go Smartwatch, Apr. 8, 2016, 9 pages.

Simvalley Mobile 1.5"-Smartwatch AW-414.Go mit Android4, BT, Wifi, Cam, http://www.simvalley-mobile.de/1-5-Android-Watch-PX-1790-919.shtml, Apr. 8, 2016, 19 pages.

Simvalley 1.5" Smart Watch GSM Mobile Phone Bluetooth Touch Screen Mp3 White, Amazon.com, http://www.amazon.com/Simvalley-Smart-Mobile-Bluetooth-Screen/dp/B00HYUEW3A, Apr. 8, 2016, 3 pages.

UP by Jawbone, A smarter fitness tracker for a fitter you, https://jawbone.com/up, Apr. 8, 2016, 16 pages.

Up by Jawbone—Large—Onyx (Discontinued by Manufacturer), http://www.amazon.com/UP-Jawbone-Large-Discontinued-Manufacturer/dp/B00A17IA1l/r, Apr. 8, 2016, 9 pages.

* cited by examiner

COUPLED MULTI-BANDS ANTENNAS IN WEARABLE WIRELESS DEVICES

CROSS-REFERENCE TO RELATED APPLICATIONS

This application is a continuation of U.S. application Ser. No. 15/891,911, filed on Feb. 8, 2018, which is a continuation of U.S. application Ser. No. 14/811,621, filed on Jul. 28, 2015, now U.S. Pat. No. 9,912,042, issued on Mar. 6, 2018. The aforementioned applications are hereby incorporated by reference in their entireties.

TECHNICAL FIELD

The present invention relates generally to systems and methods for wearable wireless communications devices, and, in particular embodiments, to systems and methods for providing coupled multi-band antennas with improved performance in wearable wireless communications devices.

BACKGROUND

Industrial design of modern wireless devices is evolving towards lower profile devices. These modern wireless devices include cellular phones, tablets, or wearables such as watches, eyeglasses and virtual reality headsets or the like. Wireless devices require multiple multi-band radio frequency (RF) antennas to operate on, or near, users. Typical antennas include cellular main antennas, diversity antennas, wireless networking (e.g., WiFi, 802.11 or Bluetooth) antennas, near field antennas (e.g., near field communication or wireless charging) and global positioning (e.g., GPS, GNSS, Beidou) antennas. Multiple multi-band antennas have to be co-designed to cooperate with each other and with other electromagnetic components such as speakers, LCD screens, batteries, sensors, etc. However, antennas in proximity to each other result in low isolation, reduced efficiency, and increased channel interference.

SUMMARY

In accordance with an embodiment of the present invention, a wearable wireless device comprises a circuit board, a housing body housing the circuit board, the housing body having a front side and a back side, the back side configured to be closer to the user when worn than the front side, a first antenna element electrically connected to the circuit board and located at the front side of the housing body and a second antenna element electrically connected to the circuit board and located at the front side of the housing body, wherein a first end of the first antenna element and a first end of the second antenna element are separated by a first distance, and wherein a second end of the first antenna element and a second end of the second antenna element are separated by a second distance.

In accordance with an embodiment of the present invention, a wearable wireless device comprises a first antenna comprising a first antenna element and a shared ground plate, a second antenna comprising a second antenna element and the shared ground plate; and a housing body housing the first and second antenna elements at a front side configured to face away from a user and a back side, opposite to the front side, the back side configured to face the user, wherein a first end of the first antenna element and a first end of the second antenna element are separated by a first distance, and wherein a second end of the first antenna element and a second end of the second antenna element are separated by a second distance.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF ILLUSTRATIVE EMBODIMENTS

Figure 1:
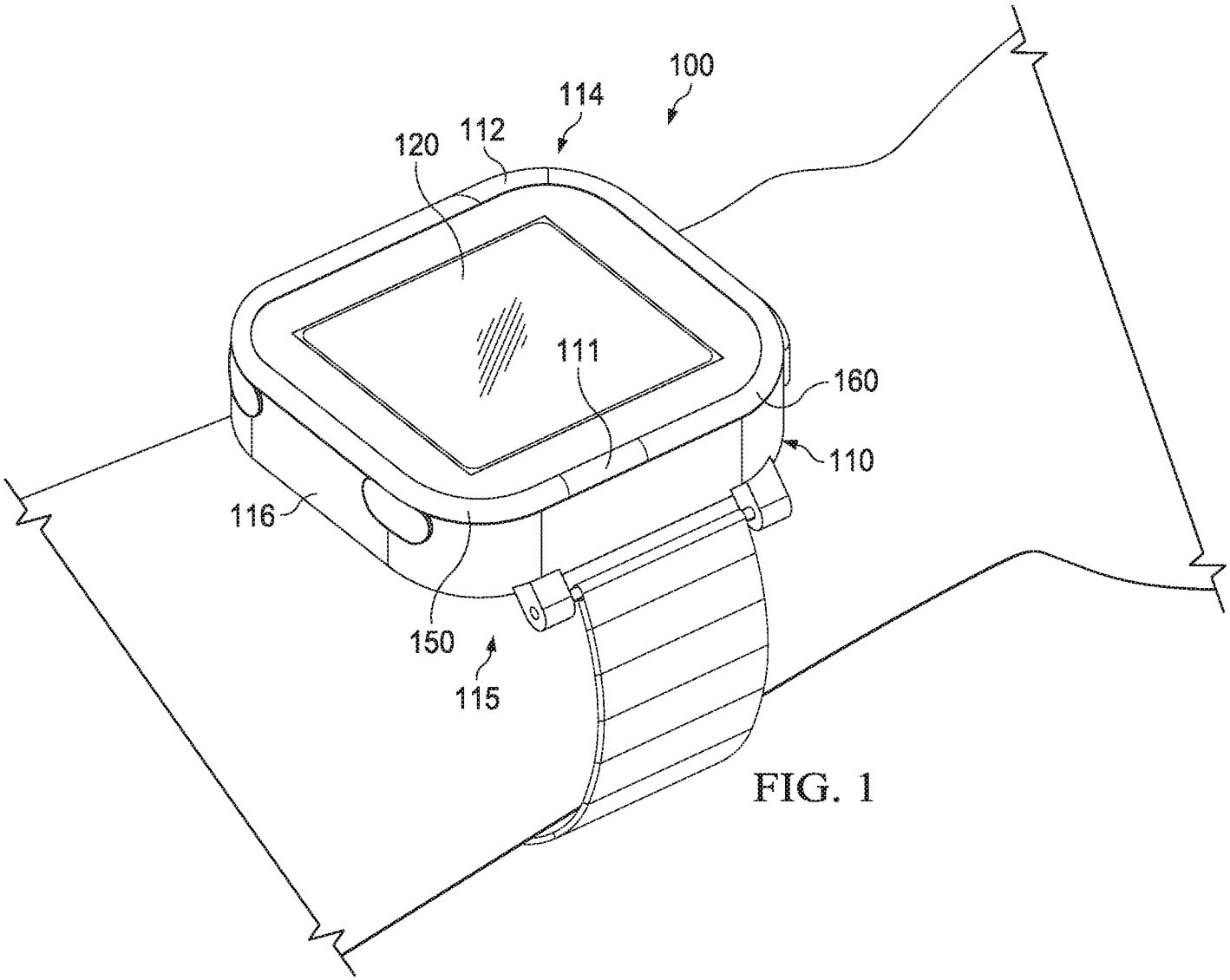
FIG. 1 illustrates a perspective view of a wearable wireless device according to an embodiment.

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention. Additionally, the methods and apparatuses described may be applied to wireless communications system antenna layout and design, but are not specifically limited to the same.

Modern communications devices provide the ability to communicate on multiple distinct channels in different frequency bands simultaneously, providing increased data throughput and multiple simultaneous wireless communications services in a single device. Many wireless communications devices are designed to be multi-band devices, with the ability to communicate on different cellular frequency bands, such as the 700 MHz-960 MHz bands, 1,700 MHz-2,700 MHz bands. Additionally, wireless devices frequently have additional features such as WiFi connectivity on, for example, the 2,400 MHz, 3,600 MHz, and 5,000 MHz bands, or the like, GPS on the 1227 MHz and 1575 MHz frequencies, and Bluetooth on the 2,400 MHz-2,485 MHz frequencies. The ability to communicate on different frequencies or bands can be provided by multi-band antennas. For example, in some devices, cellular service is provided by an antenna or a set of antennas that is configured to communicate on two or more of the different cellular frequency bands, and supplemental services are provided by a WiFi/GPS/Bluetooth antenna or a set of antennas that is configured to communicate on the WiFi, GPS and Bluetooth bands.

However, in some instances, the cellular bands and the WiFi, GPS or Bluetooth bands may overlap, causing interference when the cellular and GPS/WiFi/Bluetooth antennas are in close proximity. Additionally, in relatively small devices such as wearables (e.g., watches, eyeglasses and virtual reality headsets), handheld cellular phones, or tablet computers, the antennas for similar frequency bands are allocated on increasingly smaller space. For example, cellular antennas optimized for the 824-960 MHz and 1700-2700 MHz ranges require large volumes to work efficiently. Such frequencies are close to, or overlap with, the GPS, WiFi or Bluetooth signals. The overlapping bands, combined with the proximity of the cellular and GPS/WiFi/Bluetooth antennas introduce interference in the antennas. For example, transmission on a cellular antenna in the 1700 MHz band may cause interference with GPS signals in the 1575 MHz frequency band. Interference with such a signal is particularly problematic since the GPS signals are transmitted from satellites, resulting in weak and easily overpowered signals.

The systems and methods described herein provide coupled multiband antennas located proximate to each other. For example, the system and methods provide a multiband cellular wireless antenna and a GPS/WiFi/Bluetooth antenna that extends around a top surface of the wearable wireless device. In some embodiments, the multiband antennas are located around a display along the extremities of the wearable wireless device facing away from the nearest body or skin tissue. Such an arrangement provides minimal absorption from the skin or body and an increased radiation aperture. A suitable coupling distance is ensured between the GPS/WiFi/Bluetooth antenna and the multiband cellular antenna reducing the interference between the antennas.

In order to reduce the footprint of the antennas and the overall size of the wearable wireless device, multiple antennas are disposed at the ends of the wearable wireless device away from the user. This arrangement permits improved wireless connectivity since the antennas are located in the outer periphery of the wearable wireless device away from the body or skin of the user. The antennas have better exposures located far away from the body or skin since the skin may block or attenuate radio frequency signals. In some embodiments, improved connectivity is also provided, for example, by coupling the multiple antennas. In other embodiments a small foot print may be achieved by providing a shared ground plate (e.g., circuit board).

An advantage of some embodiments is that the feed points to the two antenna elements are located close to each other on the circuit board. The feed points may be arranged in an area of the circuit board where no other components or wires are located. In other the words, the feed points are located in an area of the circuit board with low or the least interferences, electrical disruption or distortion by other electrical elements. Using these feed locations on an allocated area of the circuit board surface improves antenna performance of the wearable wireless device. Additionally, routing the portions of the GPS/WiFi/Bluetooth antenna on different sides of the wireless device improves the antenna efficiency of the respective antennas and improves their isolation relative to each other when sharing the same or overlapping frequency bands.

FIG. 1 shows a wearable wireless device 100 wearable by a user. The wearable wireless device 100 such as a wearable wrist watch comprises a housing body 110, a display 120 and antenna elements 150, 160. The antenna elements 150, 160 are located on different sides of a front side 114 of the housing body 110 away from the body or skin of the user. In other words, the back side 115 is configured to be closer to the user when worn than the front side 114. The front side 114 of the housing body is opposite to the back side 115 of the housing body 110. The front side 114 is connected to the back side 115 via side surfaces 116. The display 120 may be arranged at the front side 114, and the back side 115 may mostly be covered by a cover casing (not shown) configured to be opened in order to replace the battery.

The wearable wireless device 100 may include a first antenna (comprising the antenna element 150) and a second antenna (comprising the antenna element 160). The antennas may be multi-mode antennas configured to communicate, transmit, and receive signals on multiple frequency bands. In some embodiments, the first antenna and the second antenna are switched antennas or smart antennas selected for frequency matching performance. Circuitry on the circuit board is configured to sense the incoming or received radio signals of the active antenna.

The first antenna may be configured to provide communication capabilities for cellular wireless communication services. The first antenna may be able to communicate in the cellular frequency bands, such as the 700 MHz-960 MHz bands, 1,700 MHz, 1,900 MHZ, 2,100 MHz, 2,500 MHz and 2,700 MHz bands. The second antenna may be configured to provide communication capabilities for communications services such as Bluetooth, GPS, WiFi, or the like. In some embodiments, the second antenna is a dual mode antenna configured to communicate, transmit or receive on multiple bands for multiple communications services. For example, the second antenna may be a GPS/WiFi/Bluetooth antenna that receives GPS positioning signals on a GPS frequency, set of frequencies or a frequency band. Such a GPS/WiFi/Bluetooth antenna may also be configured to transmit and receive WiFi signals on, for example, the 2,400 MHz, 3,600 MHz and 5,000 MHz WiFi bands. Moreover, the GPS/WiFi/Bluetooth antenna may also be configured to transmit and receive Bluetooth signals on, for example, 2,400 MHz-2,485 MHz band.

The antenna elements 150, 160 may be routed around the display 120 and may be located along the rims or edges of the top surface at a front side 114. The antenna elements 150, 160 may be arranged conformal to the ends, exterior/interior surfaces or outer/inner surfaces of the housing 110. The first antenna element 150 may extend along the top edges of the housing body 110 bending around a first corner and a second corner. The first antenna element 150 may cover a portion of the top surface and portions of the side surfaces. The second antenna element 160 may extend along other top edges of the housing body 110 bending around a third corner. It may also cover a portion of the top surface and portions of side surfaces. Such an arrangement permits for placing the GPS/WiFi/Bluetooth antenna element 160 spaced apart from the multiband cellular antenna element 150 by two distances 111, 112. The distances 111, 112 may be different. For example, the distance 112 near the feed point locations to the circuit board (discussed below at FIG. 2) may be shorter than the distance 111 far from the feed point locations. The distances 111, 112, the arrangement of the antenna elements and the housing body 110 material improve the coupling of the antennas and provide proper isolation.

The antenna elements 150, 160 may comprise a conductive material such as a metal. The metal may be copper, aluminum, or alloys of these materials. The antennas elements 150, 160 may comprise conductive material strips such as metal stripes. The antenna elements 150, 160 are typically not exposed to air on the outside of the housing 110 but are embedded therein. In other words, the antenna elements 150, 160 may be covered by the housing material or a cover material and are therefore not visible to the user. An advantage of arranging the antenna elements 150, 160 in such a way is that they are routed away from the body/skin tissues of the user and the grounded metallic structures (e.g., circuit board) of the wearable wireless device. This minimizes the electromagnetic absorption from the skin/tissue and increases the radiation aperture.

The antenna elements 150, 160 may comprise different lengths. For example, the first antenna element 150 may be a multiband cellular antenna element and the second antenna element 160 may be a multiband wireless antenna element for wireless services other than cellular services. The multiband antenna 160 may be a combination of a GPS antenna element, a WiFi antenna element, and a Bluetooth antenna element. The multiband antenna element 160 may include more or less than these three wireless services. The antenna elements 150, 160 may be shaped like or may approximate a L, or may be shaped like or approximate a U. Both antenna elements may be bent around one or more corners. For example, the multiband wireless antenna element 160 may be bent around one corner and the multiband cellular antenna element 150 may be bent around two corners. Alternatively, each of the antenna elements 150, 160 may be bent around one corner. In some embodiments, the antenna elements comprise the same form and thickness but different lengths.

Figure 2:
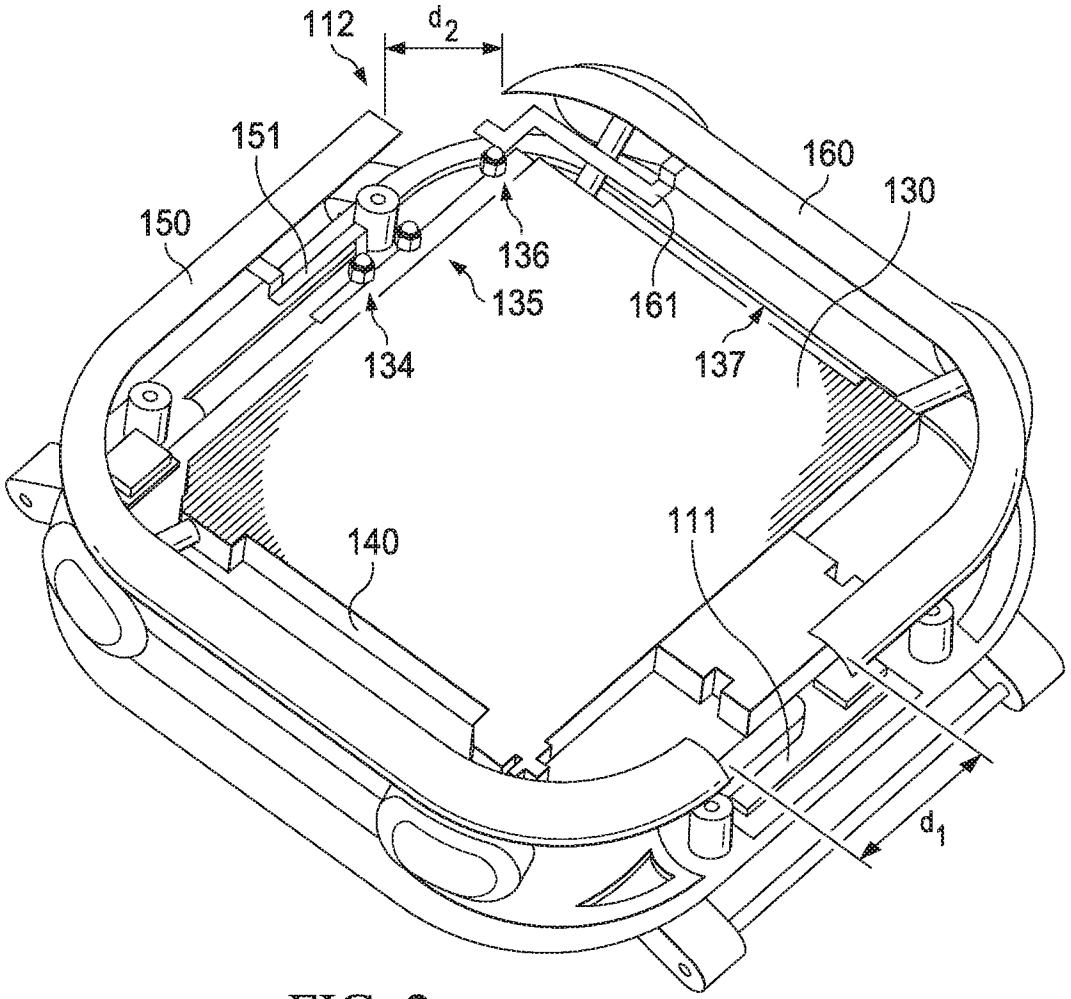
FIG. 2 illustrates a perspective view of a wearable wireless device without the housing material according to an embodiment.

The antenna elements 150, 160 each may be an element of a dipole. The other element may be the ground plate (e.g., circuit board 130 as shown in FIG. 2). For example, the first antenna element 150 and the ground plate (e.g., circuit board 130) may form a first dipole and the second antenna element 160 and the ground plate (e.g., circuit board 130) may form a second dipole, the ground plate thereby being a shared ground plate. The dipoles may be a half wave dipole. Alternatively, the antenna elements with the ground plate may form a monopole.

The first antenna element 150 may comprise a length of about 55 mm to 900 mm or about 70 mm to 900 mm. Alternatively, the first antenna element 150 may comprise a length of about 84 mm. The second antenna element 160 may comprise a length of about 40 mm to about 65 mm or about 50 mm to about 65 mm. Alternatively, the second antenna element 160 may comprise a length of about 61 mm. The first antenna element 150 may comprise a width of about 3 mm to 6 mm, or alternatively, a width of less than 10 mm or less than 5 mm. The second antenna element 160 may comprise a width of about 3 mm to 6 mm, or alternatively, a width of less than 10 mm or less than 5 mm. In various embodiments the first antenna element 150 and the second antenna element 160 may comprise the same width. The antenna elements 150, 160 may comprise a thickness of more than 3 mm.

The housing body 110 may comprise distances, regions or spaces 111, 112 between the antenna elements 150, 160. The regions 111, 112 are designed to provide radiation isolation and electric isolation between the two antenna elements 150, 160. The regions 111, 112 may be configured to reduce or minimize electro-magnetic coupling between the two antenna elements 150, 160. The material of the housing body 110 may comprise a plastic material such as a thermoplastic material (e.g., Polycarbonate/Acrylonitrile Butadiene Styrene (PC/ABS)), a glass material or rubber material. The material may be a dielectric material. The material of the housing body 110 may comprise a relative permittivity of about 2 or about 2.5. Alternatively, the material may provide a higher relative permittivity, for example up to 4.4. In yet other embodiments the housing body 110 may comprise a relative permittivity of about 2.5 to about 3.5 or to about 4.4. The higher the relative permittivity is that overlies the antenna elements 150, 160 the shorter the antenna elements 150, 160 can be. However, the higher the relative permittivity over the overlying material is the lower the efficiency of the antenna. The antennas may have a particular good efficiency when the length of the cellular antenna is about 84 mm, the length of the wireless antenna (Bluetooth, etc.) is about 61 mm and the relative permittivity of the material of the housing body 110 is about 2.5.

The antenna elements 150, 160 may be embedded in the housing material of the housing body 110. Alternatively, the antenna elements 150, 160 are located on the surface of the housing body 110 and coated by a cover material. The cover material may have the same or similar electrical properties than the housing material. In an embodiment, the housing material of the housing body 110 may have a different relative permittivity than the coating material.

FIG. 2 shows a wearable wireless device 100 without the housing body 110 (but with the antenna elements 150, 160) so that inside of the wearable wireless device 100 can be seen. In addition to the elements described earlier, the wearable wireless device 100 may further comprise a circuit board 130 and a battery 140 beneath the circuit board 130.

The circuit board 130 may be a printed circuit board (PCB) such as a 8-layer, a 10-layer or a 12-14 layer board having 8, 10, 12, 13 or 14 layers of conductive materials or elements spaced part and electrically insulated by, for example, dielectric or insulating layers such as fiberglass, polymer, or the like. The conductive layers are electrically connected by vias and may form, in their entirety, a ground plate. Components such as the display 120, the touchscreen, the input buttons, the transmitters, the processors, the memory, the battery 140, the charging circuits, the system on chip (SoC) structures, or the like may be mounted on or connected to the circuit board 130, or otherwise electrically connected to, the conductive layers in the circuit board 130.

The first antenna element 150 is connected to the circuit board 130 at a first feed point 134 located at a side 135 of the circuit board 130 and the second antenna element 160 is connected to the circuit board 130 at a second feed point 136 located at the same side 135 of the circuit board 130. Alternatively, the first feed point 134 and the second feed point 136 may be located on adjacent sides 135, 137 of the circuit board 130 near a corner. The feed points 134, 136 may be connected to the antenna elements 150, 160 via electrical conductive connections 151, 161. The feed points 134, 136 may be arranged close to one corner of the circuit board 130 away from the other corners of the board 130.

The feed points 134, 136 may be located in an area of the circuit board 130 which is devoid of conductive lines, elements or components (except of the conductive line which connects the feed points 134, 136 to the rest of the conductive lines, elements or components of the circuit board 130). The board may only comprise isolation material in this area and may be free of conductive materials. The feed points 134, 136 may be spaced apart by about 10 mm to 50 mm, or alternatively, 20 mm to 40 mm.

In some embodiments the distance $d_1$ in region 111 between ends of the two antenna elements 150, 160 is longer than the distance $d_2$ in region 112 between other ends of these antenna elements 150, 160. Accordingly, the longest open ends of antenna radiating arms (antenna elements 150, 160) are routed towards the opposite direction of the antenna feeds 134, 136. In some embodiments, the distances $d_1$ and $d_2$ may be between 10 mm and 50 mm.

As can be seen from FIG. 2, a further advantage is that the antenna elements 150, 160 are not only spaced away from the body tissue/skin but also from the ground plate 130 (ground metallic structure). This minimizes the electromagnetic absorption from the skin and interferences from the ground plate and increases the radiation aperture.

Figure 3:
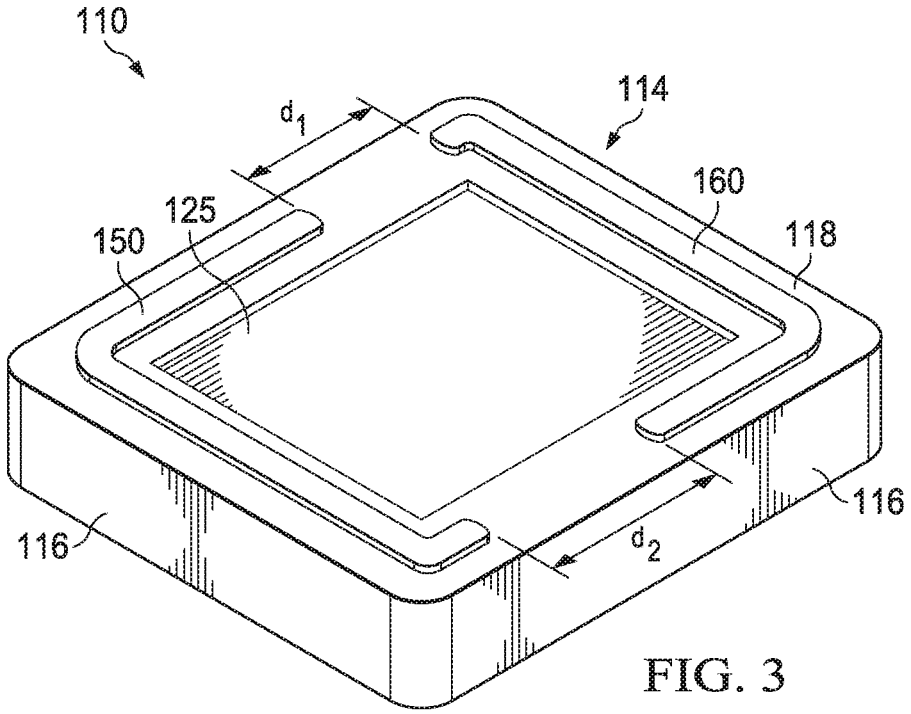
FIG. 3 illustrates a perspective view of a housing of a wearable wireless device according to an embodiment.

FIG. 3 shows a perspective view of a housing body 110 according to some embodiments. The antenna elements 150, 160 are located on the front side 114 of the housing body 110. The front side of the housing body 110 includes a top surface 118 and side surfaces 116. An opening 125 in the top surface 118 of the housing body 110 is configured to receive the display 120. The antenna elements 150, 160 are only located on the top surface 118 and not located on the side surfaces 116. The antenna elements 150, 160 are typically not seen from the outside because they are either embedded in and located near an outer surface of the housing body 110 or covered by a thin layer of a cover coating so that the antenna elements 150, 160 are protected from being scratched or otherwise damaged.

Figure 4:
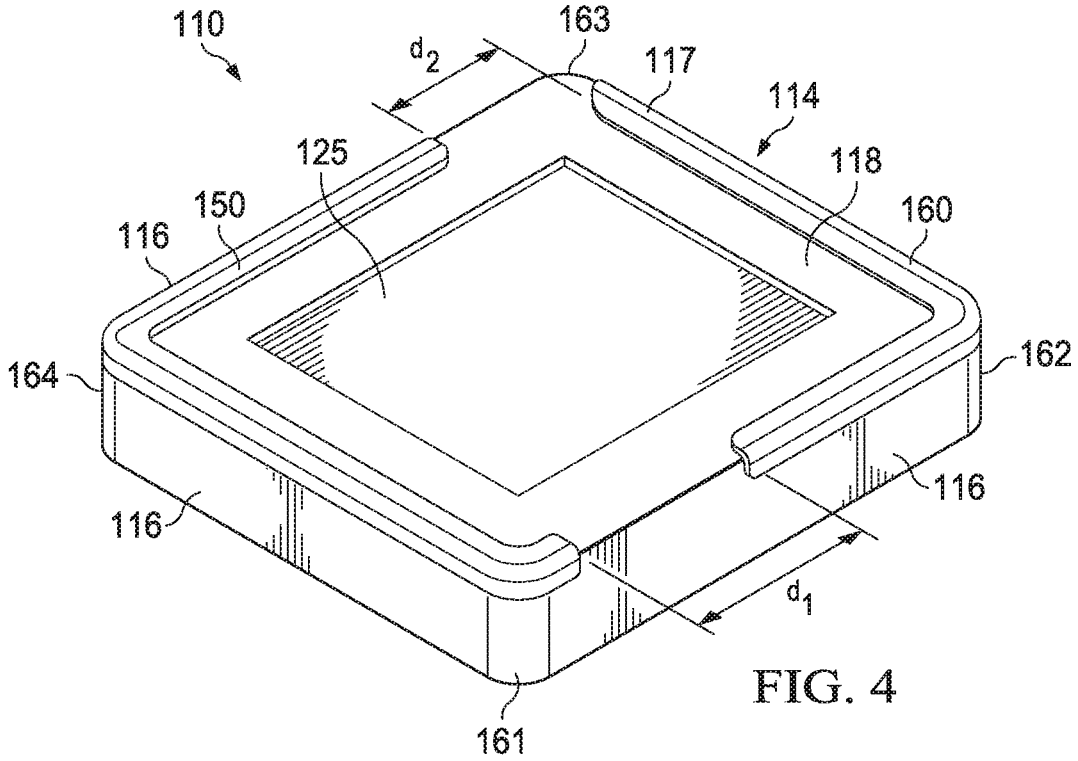
FIG. 4 illustrates another perspective view of a housing of a wearable wireless device according to an embodiment.

FIG. 4 shows another perspective view of a housing body 110 according to other embodiments. The antenna elements 150, 160 are located on the front side 114 of the housing body 110. Similar to FIG. 3, the front side 114 comprises the top surface 118 and side surfaces 116. The top surface 118 comprises an opening 125 configured to receive the display 120. The antenna elements 150, 160 are bent around the edges and the corners 161, 162 and 164 so that they are positioned at portions of the top surface 118 and the side surfaces 116. In some embodiments, the edges and the corners 161-164 are round and not angular. The antenna elements 150, 160 are embedded in and located near an outer surface of the housing body 110 or covered by a (thin) coating layer.

Figure 5:
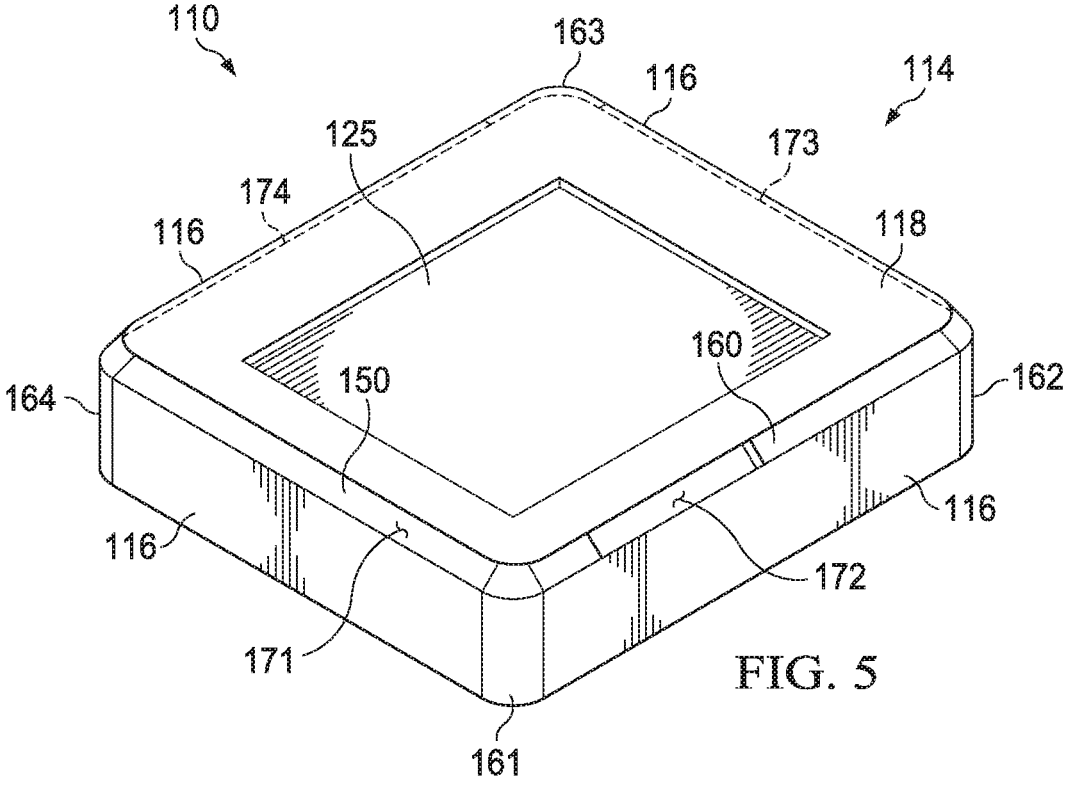
FIG. 5 illustrates yet another perspective view of a housing of a wearable wireless device according to an embodiment.

FIG. 5 shows yet another perspective view of a housing body 110 according to some other embodiments. The antenna elements 150, 160 are located on the front side 114 of the housing body 11*o*. Similar to FIG. 3, the front side 114 comprises the top surface 118 and side surfaces 116. However, the side surfaces 116 are connected to the top surface 118 via tilted, sloped or inclined connecting surfaces 171-174. The top surface 118 comprises an opening 125 configured to receive the display 120. The antenna elements 150, 160 are bent around the edges and the corners 161, 162 and 164 so that they are positioned at the area of the tilted surfaces 171-174. The antenna elements 150, 160 can be positioned at a portion of the top surface 118 and portions of the side surfaces 116. In some embodiments, the edges between the top surface 118 and the tilted surfaces and the edges between the tilted surface and the side surfaces 116, and the corners 161-164 are round and not angular. The antenna elements 150, 160 may be embedded in and located near an outer surface of the housing body 110 or covered by a (thin) coating layer.

Figure 6:
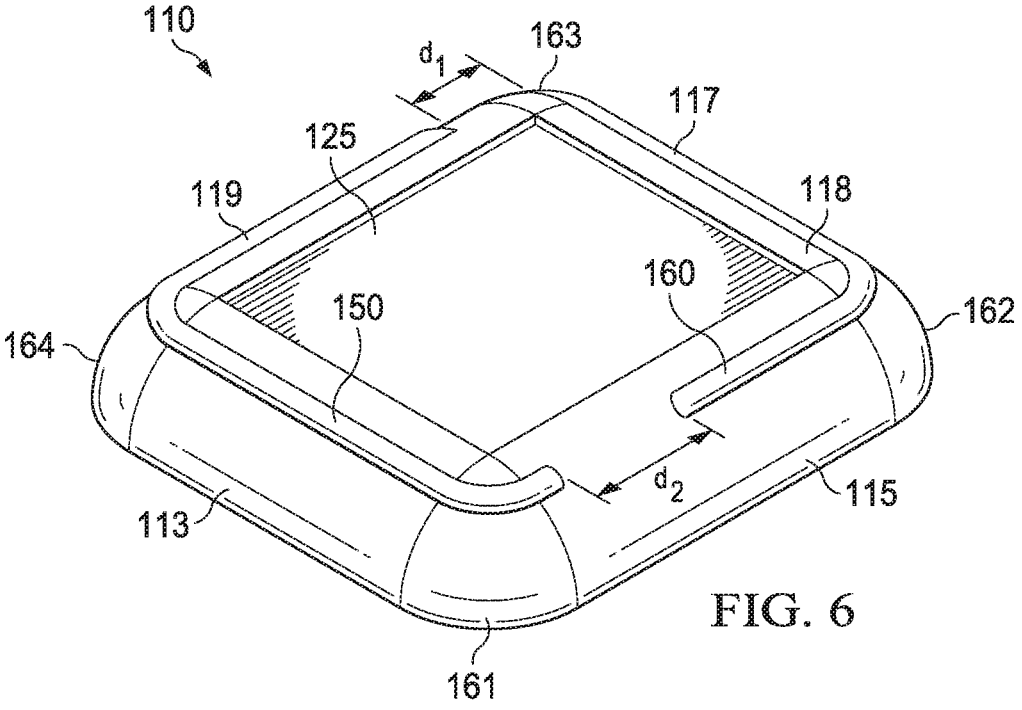
FIG. 6 illustrates a further perspective view of a housing of a wearable wireless device according to an embodiment.

FIG. 6 shows a further perspective view of a housing body 110 according to further embodiments. The antenna elements 150, 160 are located on the front side 114 of the housing body 110. Similar to FIG. 3, the front side 114 comprises the top surface 118 and demi bull noses or full bull noses 113, 115, 117 and 119 connecting the back side. The top surface 118 comprises an opening 125 configured to receive the display 120. The antenna elements 150, 160 are bent around the corners 161, 162 and 164 so that they are positioned at portions of the top surface 118 and portions of the bull noses 113, 115, 117 and 119, or alternatively only portions of the bull noses 113, 115, 117 and 119. The corners 161-164 are round and not angular. The antenna elements 150, 160 are embedded in and located near an outer surface of the housing body 110 or covered by a (thin) coating layer.

In some embodiments the dimension of the wearable wireless device may be 43 mm×43 mm×11 mm.

Embodiments of the invention include methods for wearing the wearable wireless device by a user. The method may incorporate the wireless device according to previous embodiments. The wearable wireless device can be carried not only around the wrist but on any part of the human body (e.g., as a neckless, as glasses, etc.).

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. A wrist watch comprising:
a circuit board;
a housing body housing the circuit board, the housing body having a front side and a back side;
a display located at the front side of the wrist watch;
a first antenna element electrically connected to the circuit board and located at the housing body along a first edge of the housing body; and
a second antenna element electrically connected to the circuit board and located at the housing body along a second edge of the housing body.

2. The wrist watch of claim 1, wherein the first and second antenna elements are covered by a protection layer.

3. The wrist watch of claim 1, wherein the first and second antenna elements are covered by a housing material.

4. The wrist watch of claim 1, wherein the first antenna element bends around a first corner of the housing body, and the second antenna element bends around a second corner of the housing body different than the first corner.

5. The wrist watch of claim 1, wherein the front side comprises a top surface, the first antenna element is located at the top surface along the first edge, and the second antenna element is located at the top surface along the second edge.

6. The wrist watch of claim 1, wherein the front side comprises a top surface, and the back side comprises a bottom surface with a side surface connecting the top surface and the bottom surface, and wherein the first antenna element is located at the top surface and the side surface bending around the first edge, and the second antenna element is located at the top surface and the side surface bending around the second edge.

7. The wrist watch of claim 1, wherein the front side comprises a top surface and a side surface with a tilted surface connecting the side surface to the top surface, and wherein the first and second antenna elements are located at the tilted surface.

8. The wrist watch of claim 1, wherein the front side comprises a demi bull nose structure, wherein the first and second antenna elements are located at the demi bull nose structure.

9. A wrist watch comprising:
a circuit board;
a housing body housing the circuit board, the housing body having a front side and a back side;
a display located at the front side of the wrist watch;
a first antenna element electrically connected to the circuit board and located at a first corner of the housing body; and
a second antenna element electrically connected to the circuit board and located at a second corner of the housing body different than the first corner.

10. The wrist watch of claim 9, wherein the first antenna element extends around two corners of the housing body different than the second corner.

11. The wrist watch of claim 9, wherein the first and second antenna elements are covered by a protection layer.

12. The wrist watch of claim 9, wherein the first and second antenna elements are covered by a housing material.

13. The wrist watch of claim 9, wherein the first antenna element extends along a first edge of the housing body, and the first antenna element extends along a second edge of the housing body.

14. The wrist watch of claim 9, wherein the front side comprises a top surface and the back side comprises a bottom surface with a side surface connecting the top surface and the bottom surface, and wherein the first antenna element extends over a first edge connecting the top surface and the side surface at the first corner, and the second antenna element extends over a second edge connecting the top surface and the side surface at the second corner.

15. The wrist watch of claim 9, wherein the front side comprises a top surface and the back side comprises a bottom surface with a tilted surface connecting a side surface to the top surface, and wherein the first and second antenna elements are located at the tilted surface.

16. The wrist watch of claim 9, wherein the first antenna element is a cellular antenna, and the second antenna element is a GPS/WiFi/Bluetooth antenna.

17. A wrist watch comprising:

a circuit board;

a housing body housing the circuit board, the housing body having a front side and a back side;

a display located at the front side of the wrist watch;

a first antenna element electrically connected to the circuit board and extending along an edge of the housing body; and a second antenna element electrically connected to the circuit board and extending along the edge of the housing body.

18. The wrist watch of claim 17, wherein the first and second antenna elements are covered by a protection layer.

19. The wrist watch of claim 17, wherein the first and second antenna elements are covered by a housing material.

20. The wrist watch of claim 17, wherein the first antenna element is located along a first portion of the edge of the housing body, and the second antenna element is located along a second portion of the edge of the housing body.

* * * * *